US008022290B2

(12) United States Patent
Masaki et al.

(10) Patent No.: US 8,022,290 B2
(45) Date of Patent: Sep. 20, 2011

(54) STRIKE INPUT DEVICE FOR ELECTRONIC PERCUSSION INSTRUMENT

(75) Inventors: Kazuo Masaki, Hamamatsu (JP); Yoshihisa Suzuki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/826,286

(22) Filed: Jun. 29, 2010

(65) Prior Publication Data

US 2010/0326258 A1 Dec. 30, 2010

(30) Foreign Application Priority Data

Jun. 29, 2009 (JP) ..... 2009-154011

(51) Int. Cl.
*G10H 3/10* (2006.01)

(52) U.S. Cl. ..... 84/734; 84/730

(58) Field of Classification Search ..... 84/734, 84/621, 730

See application file for complete search history.

(56) References Cited

U.S. PATENT DOCUMENTS 3,507,970 A * 4/1970 Jones ..... 84/688
3,999,457 A * 12/1976 Michel ..... 84/702
4,248,123 A * 2/1981 Bunger et al. ..... 84/699
4,628,786 A * 12/1986 Buchla ..... 84/689
4,932,303 A 6/1990 Kimpara
5,223,654 A * 6/1993 Fujita ..... 84/627

FOREIGN PATENT DOCUMENTS

JP 6-64463 8/1994

* cited by examiner

*Primary Examiner* — Jianchun Qin

(74) *Attorney, Agent, or Firm* — Morrison & Foerster LLP

(57) ABSTRACT

A piezo electric element generates a vibrating voltage in response to a striking force on a pad. The piezo electric element is connected across a series connection of a linear resistor and a nonlinear resistance network. The voltage appearing across the nonlinear resistance network is taken as an output voltage. The nonlinear resistance network is comprised of a parallel connection of a first and a second resistance circuitry. The first resistance circuitry is a series connection of a resister and two diodes connected in parallel in an opposite polarity to each other. The second resistance circuitry is a series connection of another resister and two Zener diodes connected in series in an opposite polarity to each other.

3 Claims, 4 Drawing Sheets

Circuit Configuration of Strike Input Device (Ex. 1)

Circuit Configuration of Strike Input Device (Ex. 1)

Input/Output Characteristic

Circuit Configuration of Strike Input Device (Ex. 2)

Circuit Configuration of Strike Input Device

Prior Art

*Fig. 5a* Block Diagram of Percussion Voicing Device
Prior Art
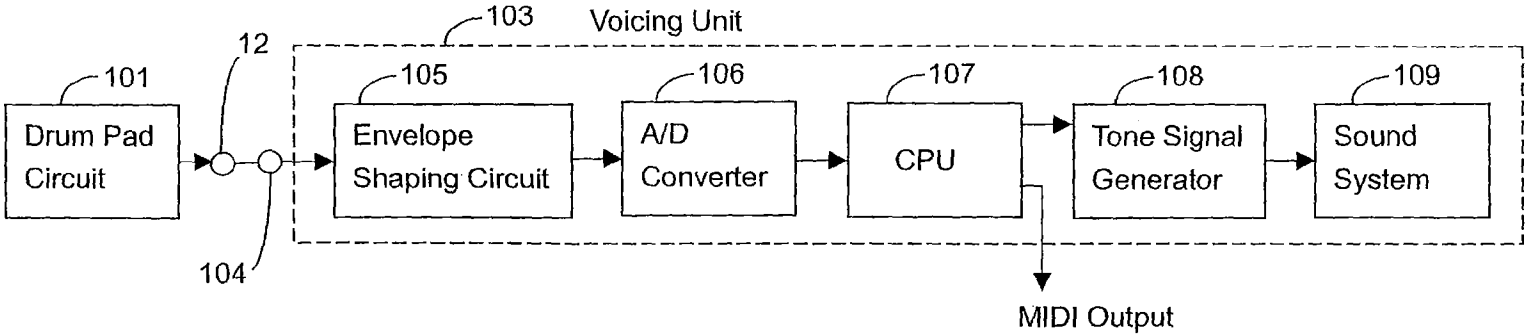
*Fig. 5b* Response Characteristic of Voicing Unit
Prior Art
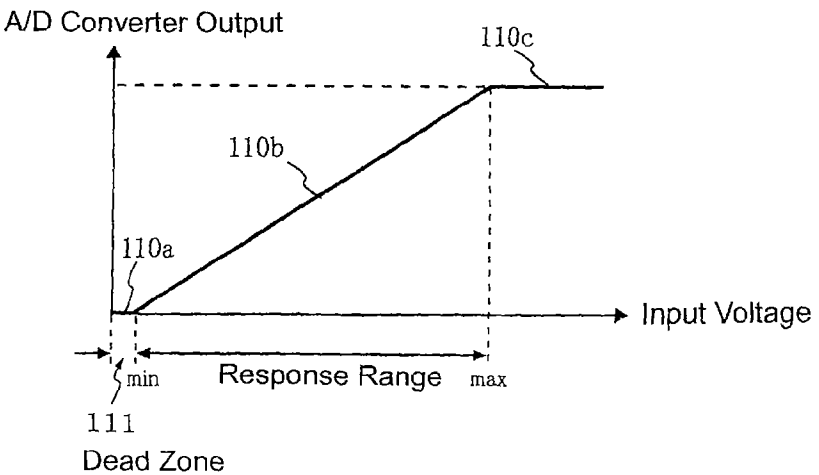

STRIKE INPUT DEVICE FOR ELECTRONIC PERCUSSION INSTRUMENT

TECHNICAL FIELD

The present invention relates to a strike input device for outputting a voltage representing a strength of a strike onto a striking pad, and more particularly to an electric circuit configuration of a strike input device for an electronic percussion musical instrument such as an electronic drum having a striking pad (i.e. music playing pad).

BACKGROUND INFORMATION

Known in the art are such electronic percussion musical instruments which have music playing manipulation devices in the form of pads (i.e. playing pads) to be struck by the player and generate electronic musical tones resembling drum sounds and cymbal sounds when the pads are struck, such as disclosed in examined Japanese patent publication No. H5-64463 and issued U.S. Pat. No. 4,932,303. When the player strikes the playing pad, the impact strength of the strike onto the pad is detected by an impact sensor such as a piezoelectric element or device. The impact sensor generates a vibrating voltage having a maximum amplitude which depends on the strength of the strike, which is a manipulation quantity of the player.

FIG. 4 shows a circuit configuration of a drum pad circuit in a conventional device. The reference numeral 101 denotes a drum pad circuit, which is installed in the body of a drum pad. The drum pad circuit comprises a piezoelectric element 2, a resister 3 having a resistance value R1, a resister 102 having a resistance value RL, and a pad output terminal 12. The vibrating voltage generated by the piezoelectric element 2 is divided by the resisters 3 and 102, and outputted from the pad output terminal 12 as a pad output voltage.

FIG. 5*a* shows a block diagrammatic configuration of a conventional percussion voicing device consisting of a drum pad circuit and a voicing unit, and FIG. 5*b* is a graph showing a response characteristic of the voicing unit of FIG. 5*a*. In FIG. 5*a*, the drum pad circuit 101, the one shown in FIG. 4, detects a strike onto the pad and outputs the detection voltage at the pad output terminal 12, which in turn is connected to an input terminal 104 of a voicing unit 103, which generates a percussion tone signal or a percussion tone representing signal accordingly responsive to the detection voltage from the drum pad circuit 101. The voicing unit 103 is installed in a general-purpose electronic musical instrument or in a dedicated electronic percussion instrument. Or alternatively, the voicing unit 103 can be installed in the body of a drum pad device, or the drum pad device itself may be comprised in a general-purpose electronic musical instrument or a dedicated electronic percussion instrument.

In the voicing unit 103, the drum pad output voltage input to the input terminal 104 is input to an envelope shaping circuit 105, which produces envelope signal representing an envelope shape of the vibrating voltage from the drum pad circuit 101. The envelope shaping circuit 105 includes a half-wave or full-wave rectifier circuit and an integrator circuit connected in cascade to output an envelope wave formed by bridging the peaks (crests) of the respective cycles of the rectified waveform one after another. The output from the envelope shaping circuit 105 is input to an A/D (analog-to-digital) converter 106, which samples the envelope wave by a predetermined sampling rate to produce a train of digital values representing the shape of the envelope wave digitally.

A central processing unit (CPU) 107 executes a computer program using a read only memory (ROM) or a random access memory (RAM), not shown though, and detects the maximum amplitude value of the envelope wave. Typically, the peak value (crest value) of the first cycle of the vibrating voltage which is generated by a single strike will make the maximum amplitude value among the decaying vibrating wave cycles caused by the single strike. It is simply because of easiness of the signal processing that the vibrating voltage wave is shaped into an envelope waveform, but the input vibrating voltage wave itself or a half-wave rectified or full-wave rectified wave of the input vibrating voltage wave may be input to the A/D converter 106. The CPU 107 digitally outputs in real time the maximum amplitude value as an output representing the magnitude of the strike force at the time point when the maximum amplitude is detected as a moment (time point) of the strike. For example, the CPU 107 outputs a note-on event message under the MIDI protocol containing the maximum amplitude value as a velocity value in the MIDI message. The CPU further drives a tone signal generator 108 to generate, at the moment of the strike, a percussion tone wave signal having an amplitude which corresponds to the maximum amplitude value of the vibration. The generated percussion tone wave signal which is a digital signal is then converted to an analog tone wave signal by a sound system 109 to be emitted from a loudspeaker as audible sound.

The drum pad circuit 101 shown in FIG. 4, however, has a drawback in that the operating range (i.e. the dynamic range) of a percussion voicing device will be limited to some narrow extent, making it difficult to generate faithful sounds for both a very strong strike and a very weak (soft) strike, when combined with the voicing unit 103 shown in FIG. 5*a*. The graph of FIG. 5*b* explains the response characteristic of the voicing unit 103 representing the relationship between the input voltage (absolute value of instantaneous voltage) to the input terminal 104 taken in abscissa and the output (absolute value of instantaneous voltage) from the A/D converter 106, which output is the digital conversion from the analog envelope wave, taken in ordinate. The characteristic line consists of three segments 110*a*, 110*b* and 110*c*. Strictly speaking, the line segment 110*b* is stepwise, but for simplicity it is depicted in a straight line.

The output of the A/D converter 106 in the voicing unit 103 is a digital value which is proportional to the input voltage at the input terminal 104 as depicted generally by a line segment 110*b*. More specifically, however, the A/D converter 106 will not increase its output value beyond its operating range where the input value exceeds its upper limit value (max), and keeps its maximum digital value as shown by a line segment 110*c*. Thus the increase in the input voltage will not be reflected as an increase in the output digital value. On the other hand, the A/D converter 106 outputs a zero value where the input value does not exceed its lower limit value (min), which is equal to one half of the resolution, and its digital "0" value is maintained within a certain dead zone 111 as shown by a line segment 110*a*. In the case of an A/D converter 106 with a limited number of coding bits, the amount of this lower limit input value (min) is not negligible. Therefore, in order for the voicing unit 103 to output digital values which increase faithfully in accordance with the input voltage, the input voltage (absolute value of instantaneous value) should be within the response range between the lower limit input value (min) and the upper limit input value (max). Where the operating range of the A/D converter 106 is narrow, the upper limit input value (max) cannot be high enough, and where the resolution is low (i.e. the number of coding bits is small), the lower limit input value (min) cannot be small enough, the response range will be narrow accordingly.

The problem in connection with the A/D converter 106 has been described above. In addition, there can be a problem that the voicing unit 103 may operate erroneously when the magnitude of the input voltage is small as compared with the noise level in the unit. Further, depending on a specific circuit configuration of the envelope shaping circuit 105, a small input voltage may not give an output due to the diodes included in the rectifying circuit, which means the envelope shaping circuit 105 also has a restriction of a lower limit input value (min). Still further, where the vibrating voltage is amplified through an amplifier, the amplifier may place a restriction of an upper limit input value (max) due to the saturation phenomenon of the amplifier.

Thus, in order for the voicing unit 103 to respond to any maximum amplitude values of the vibrating voltage, there is a restriction as to the input range of the maximum amplitude values of the vibrating voltage. To cope with such a restriction, it will be necessary to properly adjust or set the division ratio by the resistors 3 and 102 in the drum pad circuit 101 shown in FIG. 4, so that the maximum amplitude values of the vibrating voltage outputted from the drum pad circuit 101 should not exceed the above-described input range of the voicing unit 103 within the range of strength of the strikes given by the player.

On the other hand, the division ratio by the resistors should be set rather high so that the maximum amplitude value of the vibrating voltage outputted from the drum pad circuit 101 should not fall within the dead zone 111 as shown in FIG. 5*b*, even when the player strikes the drum pad weakly. Then, trouble is that the maximum amplitude values of the vibrating voltage would exceed the upper limit input value (max) while the strength of the strikes is not so large yet. As a result, even though the player strikes the pad strongly, the maximum amplitude values of the vibrating voltage outputted from the A/D converter 106 would not be accordingly high.

SUMMARY OF THE INVENTION

In view of the foregoing circumstances, therefore, it is a primary object of the present invention to provide a strike input device for an electronic percussion instrument, in which the maximum amplitude values of the vibrating voltage outputted from the strike input device are kept within a adequate width of range in response to the strikes of a wide range of strength.

According to the present invention, the object is accomplished by providing a strike input device comprising: an impact sensor for generating a first vibrating voltage in response to a striking force; and a nonlinear circuit having a nonlinear input/output characteristic and outputting a second vibrating voltage in accordance with the first vibrating voltage input from the impact sensor, the second vibrating voltage being nonlinearly related to the first vibrating voltage, wherein the nonlinear input/output characteristic represents a first increase rate of the absolute value of the output voltage to the absolute value of the input voltage where the absolute value of the input voltage is in the lower range, a second increase rate of the absolute value of the output voltage to the absolute value of the input voltage where the absolute value of the input voltage is in the middle range, and a third increase rate of the absolute value of the output voltage to the absolute value of the input voltage where the absolute value of the input voltage is in the higher range, the first increase rate being greater than the second increase rate, the third increase rate being smaller than the second increase rate but not zero. Thus, the output voltage from the strike input device, i.e. the vibrating voltage outputted from the nonlinear circuit, has a magnitude which is equal to or close to the vibrating voltage generated by the impact sensor where the strength of the strike is in the weak range, while the vibrating voltage generated by the impact sensor is suppressed from increasing linearly where the strength of the strike is in the strong range. Consequently, the maximum amplitude value of the output vibrating voltage can be kept within a predetermined output range, for a wide range of strength of the strike.

With a voicing unit to which is input an output from a strike input device according to the present invention, the maximum amplitude value of a vibrating voltage needs to be within a predetermined input range so that the maximum amplitude value of the vibrating voltage can be adequately detected and responded. Therefore, conforming the predetermined output range for the maximum amplitude value of the vibrating voltage outputted from the strike input device according to the present invention with the above-mentioned predetermined input range of the subsequent voicing unit will enlarge the input range of the strength of strike acceptable by the voicing unit for detecting the maximum amplitude of the vibrating voltage and responding accordingly to generate percussion tones.

As modifications of the above-described configuration, the following input/output characteristics of the nonlinear circuit will be still advantageous as compared to the conventional configuration. A first modification would be that the nonlinear input/output characteristic represents a larger ratio of the increase in the absolute value of the output second vibrating voltage to the increase in the absolute value of the input first vibrating voltage where the absolute value of the input first vibrating voltage is in the small range than the ratio where the absolute value of the input first vibrating voltage is in the middle range, and a same ratio where the absolute value of the input first voltage vibrating voltage is in the large range as the ratio where the absolute value of the input first vibrating voltage is in the middle range. According to this modification, the maximum amplitude value of the output second vibrating voltage can be raised above a predetermined lower limit.

A second modification would be that the nonlinear input/output characteristic represents a smaller, but not zero, ratio of the increase in the absolute value of the output second vibrating voltage to the increase in the absolute value of the input first vibrating voltage, where the absolute value of the input first vibrating voltage is in the large range than the ratio where the absolute value of the input first vibrating voltage is in the middle range, and a same ratio where the absolute value of the input first voltage vibrating voltage is in the small range as the ratio where the absolute value of the input first vibrating voltage is in the middle range. According to this modification, the maximum amplitude value of the output second vibrating voltage can be suppressed below a predetermined upper limit, responding to the variation of the maximum amplitude voltage up to the strong strike range.

In an aspect of the present invention, the nonlinear input/output characteristic of the nonlinear circuit represents a first increase rate of the absolute value of the output voltage to the absolute value of the input voltage where the input voltage is lower than a first threshold voltage, a second increase rate of the absolute value of the output voltage to the absolute value of the input voltage where the input voltage is higher than the first threshold voltage and lower than a second threshold vantage, and a third increase rate of the absolute value of the output voltage to the absolute value of the input voltage where the input voltage is higher than the second threshold voltage, the first increase rate being greater than the second increase rate, the third increase rate being smaller than the second increase rate but not zero. Thus, the condition for the nonlinear input/output characteristic can be easily established.

In another aspect of the present invention, the nonlinear circuit is comprised of a series connection of a linear resistance circuit and a nonlinear resistance circuit, the output being taken across the nonlinear resistance circuit, wherein the nonlinear resistance circuit is comprised of a parallel connection of at least a first resistance circuit and a second resistance circuit, the first resistance circuit including two diodes connected in parallel in an opposite polarity to each other, the second resistance circuit including two Zener diodes connected in series in an opposite polarity to each other. Thus, the nonlinear input/output characteristic of the strike input device can be easily established, using only passive circuit components. The passive circuit components does not need a battery or an electric power supply.

According to the present invention, a strike input device is advantageous in that the dynamic range, i.e. the range between the weakest strike and the strongest strike, will be widened, keeping the maximum amplitude voltages outputted from the strike input device within a predetermined (requisite) range acceptable by the subsequent voicing unit. Accordingly, the subsequent voicing unit to which the output voltage from the strike input device according to the present invention can respond to weak strikes as well as to strong strikes discriminating the variation of strikes in the strong strike range. An electronic percussion musical instrument having a percussion voicing device to which a strike input device according to the present invention is applied can provide a wide range of musical expression in good accordance with the variation in the strength of the player's strikes. A voicing unit to which a strike input device according to the present invention is connected can be configured with an inexpensive A/D converter having a low (rough) resolution and a narrow operating range, and can still generate percussion tones accordingly responding to a wide range of strengths of the player's strikes as in the case of a voicing unit comprised of a quality A/D converter having a high (precise) resolution and a wide operating range.

The invention and its various embodiments can now be better understood by turning to the following detailed description of the preferred embodiments which are presented as illustrated examples of the invention defined in the claims. It is expressly understood that the invention as is defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which:

FIG. 5*a* is a block diagram showing the configuration of a conventional percussion voicing device including a voicing unit; and FIG. 5*b* is a graph showing a response characteristic of the voicing unit.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

Figure 1:
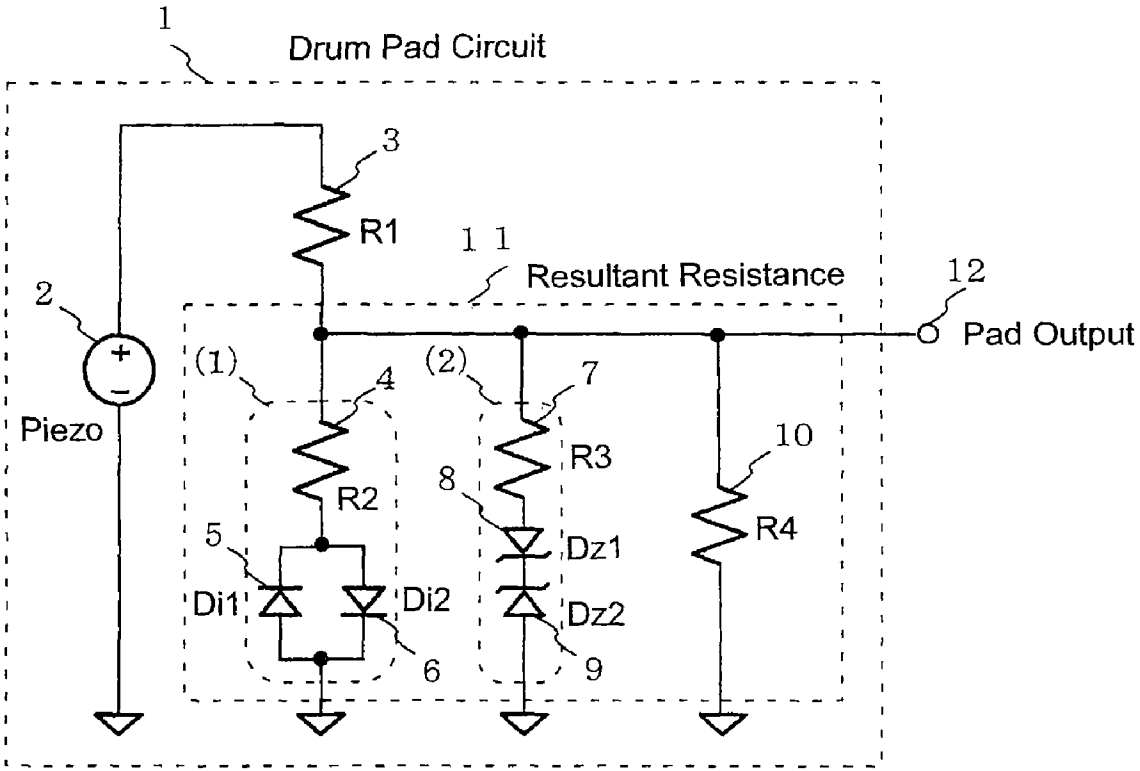
FIG. 1 is a circuit diagram showing the configuration of a drum pad circuit as a strike input device according to an embodiment of the present invention.
Figure 4:
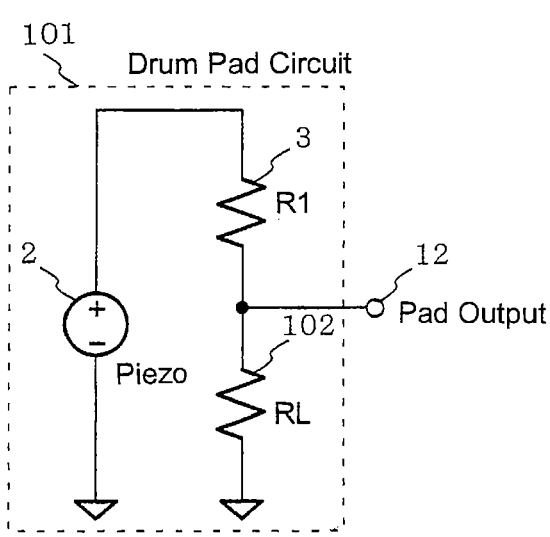
FIG. 4 is a circuit diagram showing the configuration of a drum pad circuit in a conventional device.

FIG. 1 shows a circuit configuration of a drum pad circuit 1 as a strike input device according to an embodiment of the present invention. In FIG. 1, like parts as in FIG. 4 are given like reference numerals or symbols as those in FIG. 4. The output from the drum pad circuit 1 is to be supplied to the input terminal 104 of the conventional voicing unit 103 of FIG. 4. The drum pad circuit 1 comprises a piezoelectric element (impact sensor) 2, a resistor 3 having a linear resistance R1, a resultant resistance network 11 having a nonlinear resistance, and an output terminal 12. The resultant resistance network 11 is comprised of resistors 4 (resistance R2), 7 (resistance R3), 10 (resistance R4), diodes 5 (Di1), 6 (Di2), and Zener diodes 8 (Dz1), 9 (Dz2). The piezoelectric element (impact sensor) 2 is fixed on a striking pad (not shown) of the strike input device (music playing manipulation device) and generates a vibrating voltage in response to a strike onto the striking pad. The vibrating voltage exhibits a decaying wave shape with amplitudes which corresponds to the strength of a strike on to the striking pad, however, the peak amplitude does not necessarily come at the first cycle of the vibration, as the mode of the induced vibration of the pad will not be uniform but will vary according to the manner of the strike and the positional relation between the struck point of the pad and the sensor fixed point. The maximum amplitude may come at the first cycle or may come after several cycles of the vibration. Across the piezoelectric element 2 is connected a series connection of the resistor 3 having a linear resistance R1 and the resultant resistance network 11 exhibiting a nonlinear resistance. The series connection presents a nonlinear voltage dividing ratio, and the divided voltage appearing across the resultant resistance network is taken out as an output of the drum pad circuit 1 from the output terminal 12.

The nonlinear resultant resistance network 11 comprises a parallel connection of at least a first resistance circuitry (1) and a second resistance circuitry (2). The network 11 shown in FIG. 1 further comprise a linear resistor (resistance R4) 10 further connected in parallel. The first resistance circuitry (1) comprises at least two diodes 5, 6 of a same characteristic connected in parallel in an opposite polarity to each other. The shown example further comprises a resistor 4 connected in series with the parallel connection of the diodes 5, 6. The diode (5, 6) is an element having a variable impedance characteristic which is not conductive below the conduction voltage (first threshold voltage) of about 0.6 volts applied across the diode in the forward-biased direction and abruptly becomes conductive as the forward applied voltage exceeds the conduction voltage, exhibiting an internal resistance of approximately zero. As the two diodes 5, 6 are connected in parallel in an opposite polarity to each other, the impedance characteristic is symmetrical in positive and negative directions of the current flow, facilitating the detection of the peak (maximum) amplitude of the vibrating voltage from one cycle of the vibration. Even if the vibration starts with a negative spike depending on the relation between the strike position and the sensor position, a first peak will be picked up accordingly.

The second resistance circuitry (2) comprises at least two Zener diodes 8, 9 of a same characteristic connected in series in an opposite polarity to each other. The shown example further comprises a resistor 7 connected in series with the series connection of the Zener diodes 7, 8. A Zener diode (8, 9) is an element having a variable impedance characteristic, showing, in its forward current direction, a same characteristic as an ordinary diode, and showing, in its reverse current direction, a non conductive characteristic below the Zener voltage becoming abruptly conductive beyond the Zener voltage to exhibit an internal resistance of approximately zero. As the diodes 5, 6 are connected in parallel in an opposite polarity to each other, and the Zener diodes 8, 9 are connected in series in an opposite polarity to each other, the resultant resistance network presents a symmetrical characteristic for positive and negative swings of the vibrating voltage, so that the subsequent envelope shaping circuit 105 can detect the absolute value of the vibrating voltage both from a positive swing and from a negative swing.

Figure 2:
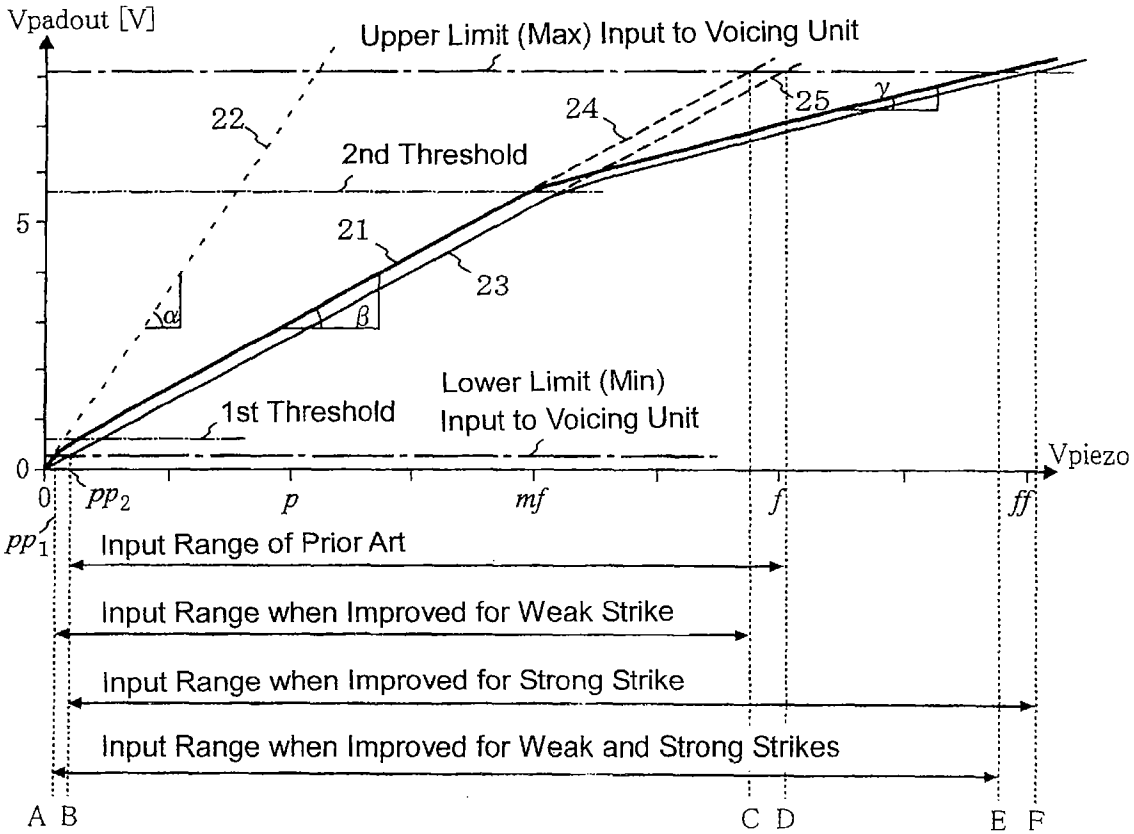
FIG. 2 is a graph showing an input/output characteristic of the drum pad circuit of FIG. 1, and also depicting an input/output characteristic of a modified configuration as well as of a conventional drum pad circuit (shown in FIG. 4) for comparison.

FIG. 2 is a graph showing an input/output characteristic of the drum pad circuit 1 shown in FIG. 1. The graph also shows an input/output characteristic of a modified configuration as well as that of a conventional drum pad circuit 101 (shown in FIG. 4) for comparison. In the graph, the abscissa represents an output voltage Vpiezo (absolute value of instantaneous voltage) from the piezoelectric element 2 and the ordinate represents an output voltage Vpadout (absolute value of instantaneous voltage) appearing at the output terminal 12. It should be understood that when the voltage outputted from the piezoelectric element 2 is negative, the output voltage appearing at the output terminal 12 is negative. As explained above with reference to FIG. 5*b*, the input voltage to the voicing unit 103 has to be kept within the detectable range between the lower limit (min) for the input and the upper limit (max) for the input so that the voicing unit 103 will operate with increasing digital values in response to increasing values of the input voltage. The input voltage to the voicing unit 103 is indeed the output voltage appearing at the output terminal 12 of the drum pad circuit 1 of FIG. 1. In FIG. 2, therefore, the graph also shows in a dash-single-dot line the lower limit value (min) and the upper limit value (max) for the input to the voicing unit 103 in the ordinate.

In FIG. 2, a solid line 21 indicates the input/output characteristic of the drum pad circuit 1 of FIG. 1. When the drum pad is struck weakly (softly), the output voltage from the piezoelectric element 2 is still small (low) and the absolute value of the output voltage at the output terminal 12 is accordingly below the conduction voltage (1st threshold) of 0.6 volt of the diodes 5, 6, and no current flows through the resistance circuitry (1). The Zener voltage Vz of the Zener diodes is of course higher than 0.6 volt, and accordingly no current flows through the resistance circuitry (2). Under these circumstances, the output voltage Vpadout at the output terminal 12 is expressed by the following equation Eq. 1 with respect to the output voltage Vpiezo from the piezoelectric element 2. The symbol "/" (slash) means a mathematical division in the equation.

$$Vpadout=(Vpiezo/R1)/(1/R1+1/R4) \quad \text{Eq.1}$$

Within this low voltage range, the ratio "(1/R1)/(1/R1+1/R4)," which is the gradient alpha (α) in FIG. 2, of the increase in the absolute value of the output voltage Vpadout at the output terminal 12 (i.e. the output voltage from the nonlinear voltage dividing network) to the increase in the absolute value of the output voltage Vpiezo from the piezoelectric element 2 (i.e. the input voltage to the nonlinear voltage dividing network) is greater than the ratio "(1/R1)/(1/R1+1/R2+1/R4)," which is the gradient beta (β) in FIG. 2, of the increase in Vpadout to the increase in Vpiezo at the time the diodes 5, 6 are conducting, as described herein-later. The larger the resistance value R4 of the resister 10 is, the larger the ratio (i.e. increase rate) will be, and the increase rate will be at its maximum "1" where the resistance value R4 is infinite. The existing resistor 10 keeps the output impedance finite and serves to prevent the network from picking up noise signals. In this range, a vibrating voltage having an amount which is very or fairly close to the vibrating voltage generated by the piezoelectric element 2 will be outputted from the output terminal 12. This means that the vibrating voltage at the output terminal 12 will become large enough to easily exceed the lower limit (min) of input to the voicing unit 103.

A description will next be made about the range in which the absolute value of the output voltage Vpadout at the output terminal 12 exceeds the conduction voltage (1st threshold) of 0.6 volt of the diodes 5, 6, but remains below the conduction voltage (2nd threshold) Vz of the Zener diodes 8, 9. The output voltage Vpadout at the output terminal 12 will be expressed approximately by the following equation Eq.2 with respect to the output voltage Vpiezo from the piezoelectric element 2.

$$Vpadout=(Vpiezo/R1+0.6/R2)/(1/R1+1/R2+1/R4) \quad \text{Eq.2}$$

As described above, the ratio of the increase in the absolute value of the output voltage Vpadout at the output terminal 12 (i.e. the output voltage from the nonlinear voltage dividing network) to the increase in the absolute value of the output voltage Vpiezo from the piezoelectric element 2 (i.e. the input voltage to the nonlinear voltage dividing network) is the ratio "(1/R1)/(1/R1+1/R2+1/R4)," which is the gradient beta (β) in FIG. 2.

In the range where the absolute value of the output voltage Vpadout at the output terminal 12 exceed the conduction voltage (2nd threshold) Vz of the Zener diodes 8, 9, the output voltage Vpadout at the output terminal 12 will be expressed approximately by the following equation Eq.3 with respect to the output voltage Vpiezo from the piezoelectric element 2.

$$Vpadout=(Vpiezo/R1+0.6/R2+Vz/R3)/(1/R1+1/R2+1/R3+1/R4) \quad \text{Eq.3}$$

Under this condition, the ratio of the increase in the absolute value of the output voltage Vpadout at the output terminal 12 (i.e. the output voltage from the nonlinear voltage dividing network) to the increase in the absolute value of the output voltage Vpiezo from the piezoelectric element 2 (i.e. the input voltage to the nonlinear voltage dividing network) is the ratio "(1/R1)/(1/R1+1/R2+1/R3+1/R4)," which is the gradient gamma (γ) in FIG. 2.

In this range, i.e. where the absolute value of the output voltage at the output terminal 12 is above the second threshold value, the ratio of the increase in the absolute value of the output voltage at the output terminal 12 (i.e. the output voltage from the nonlinear voltage dividing network) to the increase in the absolute value of the output voltage from the piezoelectric element 2 (i.e. the input voltage to the nonlinear voltage dividing network) is smaller than in the range below the second threshold value. It should be noted, however, that this ratio should not be zero, so that the vibrating voltage should increase at any rate as the input voltage increases.

Consequently, where the vibrating voltage generated by the piezoelectric element grows larger in the highest range, the drum pad circuit 1 delivers vibrating voltage growing at a compressed rate. Strictly speaking, the above-mentioned Vz is the Zener voltage plus the forward-direction resistance of the diode, as two Zener diodes 8, 9 are connected in series.

The output voltage of the piezoelectric element at the intersection of the characteristic line 21 of the drum pad circuit 1 of FIG. 1 with the lower limit input line (min) to the voicing unit 103 is designated as "A," and the output voltage of the piezoelectric element at the intersection of the same with the upper limit input line (max) to the voicing unit 103 is designated as "E." The range between "A" and "E" is an input range from the piezoelectric element 2 to the nonlinear voltage dividing network when improved for weak and strong strikes, in which range the voicing unit 103 of FIG. 5 will adequately detect the vibrating voltage and work. The voicing unit 103 thus respond to the strikes of strengths from pianissimo (pp1) up to fortissimo (ff), detecting the maximum amplitude of the vibrating voltage outputted from the piezoelectric element 2. If the first resistance circuitry (1) were with only the resistor 4 and not with the diodes 5, 6, i.e. if the resistor 4 were directly grounded, the input/output characteristic would be of the line 23, which means a situation where the input/output characteristic is improved in the strong strike range. On the other hand, if the second resistance circuitry (2) were not provided, the input/output characteristic line 21 would be extended straight as shown by the broken line 24, which means a situation where the output voltage from the piezoelectric element 2 reaches the upper limit input line (max) when the strength of the strike is still at forte (f) level.

Hereinbelow will be discussed the conventional drum pad circuit 101 shown in FIG. 4. Assuming that the resistance value RL of the resistor 102 is equal to a resultant resistance of a parallel connection of the resistor 4 and the resistor 10 of FIG. 1, namely, $$RL=1/(1/R2+1/R4) \quad \text{Eq.4}$$

then, the input/output characteristic is of the line 25 in FIG. 2.

The output voltage of the piezoelectric element at the intersection of the characteristic line 25 of the drum pad circuit 101 of FIG. 4 with the lower limit input line (min) to the voicing unit 103 is designated as "B," pianissimo (pp2) and the output voltage of the piezoelectric element at the intersection of the same with the upper limit input line (max) to the voicing unit 103 is designated as "D," forte (f). The range between "B" and "D" is an input range from the piezoelectric element 2 to the linear voltage dividing network, in which range the voicing unit 103 of FIG. 5 will adequately detect the vibrating voltage and work. Comparing with the above discussion, the drum pad circuit 1 of FIG. 1 is improved to have a response range expanded from "D" to "E" in the strong strike range as compared with the conventional drum pad circuit 101 shown in FIG. 4. On the other hand, in the weak strike range, the response range is expanded from "B" to "A" as compared with the conventional drum pad circuit 101. Although the difference between "A" and "B" is not very big, this is worthwhile in detecting or utilizing the player's strike intention maximally.

If the drum pad circuit 1 of FIG. 1 has the second resistance circuitry (2) as is shown but the first resistance circuitry (1) with only the resistor 4 (in this case, the resistors 4 and 10 are consolidated into one resistor having a parallel resultant resistance of the two resistors), then the input/output characteristic will be of the line 23, and the response range, i.e. the strike strength range acceptable by the voicing unit 103 will be between "B" and "F." In this case, available input range is improved in the strong strike range as compared with the conventional drum pad circuit 101 of FIG. 4. On the other hand, if the drum pad circuit 1 of FIG. 1 has the first resistance circuitry (1) as is shown but not the second resistance circuitry (2), then the input/output characteristic will be of the line 24, and the response range, i.e. the strike strength range acceptable by the voicing unit 103 will be between "A" and "C." In this case, available input range is improved in the weak strike range as compared with the conventional drum pad circuit 101 of FIG. 4.

Figure 3:
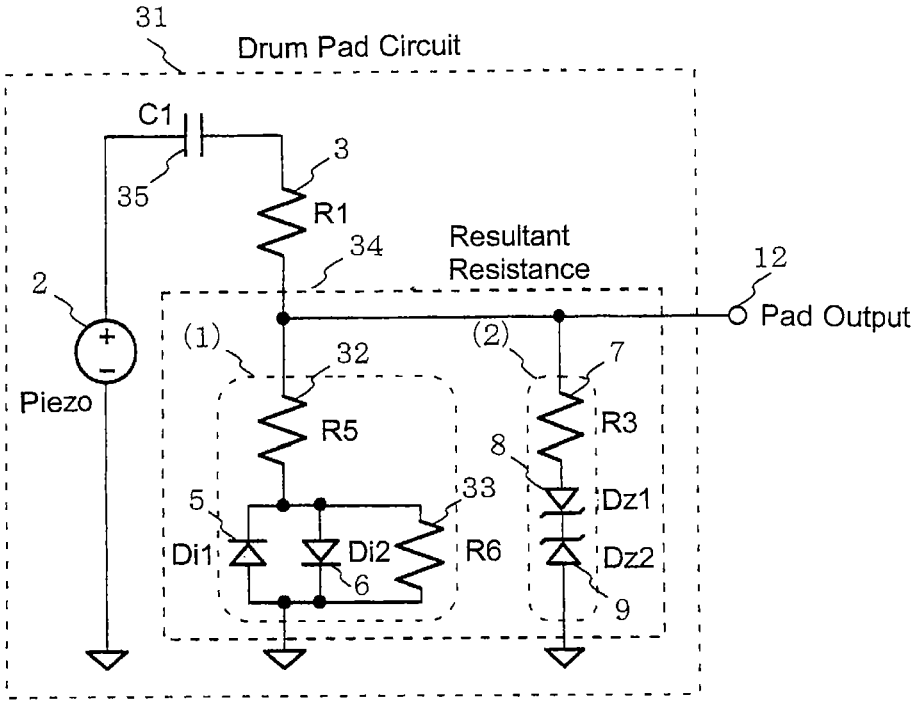
FIG. 3 is a circuit diagram showing the configuration of a drum pad circuit as a strike input device according to another embodiment of the present invention.

FIG. 3 shows the configuration of a drum pad circuit as a strike input device according to another embodiment of the present invention. In FIG. 3, like parts as those in FIG. 1 are given like reference numerals or symbols as those in FIG. 1. The drum pad circuit 31 comprises a piezoelectric element (impact sensor) 2, a resistor 3 having a linear resistance R1, a resultant resistance network 34 having a nonlinear resistance, and an output terminal 12. The resultant resistance network 34 is comprised of resistors 32 (resistance R5), 33 (resistance R6), 7 (resistance R3), diodes 5 (Di1), 6 (Di2), and Zener diodes 8 (Dz1), 9 (Dz2).

This embodiment is different from the drum pad circuit 1 of FIG. 1 in that the resistor 33 is connected in parallel with the parallel connection of the diodes 5, 6 in the first resistance circuitry (1) instead of the resistor 10 in FIG. 1. The resistance value R6 of the resistor 33 is high as the resistor 10, and the resistance value R5 of the resistor 32 may be the same as the resistance value R2 of the resistor 4 of FIG. 1. A capacitor 35 (capacitance C1) is inserted in series to the resistor 3 to cut a direct current component and low frequency components included in the vibration voltage generated by the piezoelectric element 2. But this is not indispensable. The drum pad circuit 1 of FIG. 1 may have this capacitor 35 as well. The input/output characteristic of the drum pad circuit 31 is the same as the input/output characteristic as shown in FIG. 2 of the drum pad circuit 1.

In the above description, the resistors 3 and 4 are fixed resistors. But the two resistors 3 and 4 may be replaced by a potentiometer with its sliding contact connected to the second resistance circuitry (2), the resistor 10 and the output terminal 12. The potentiometer will serve to adjust or vary the voltage division ratio to compensate the characteristic difference of the piezoelectric element or to cope with the characteristic difference of the voicing unit 103. Further, in the drum pad circuit 31 of FIG. 3, the resistor 3 and the resistor 32 may be replaced by a potentiometer to adjust the voltage division ratio. While the above description is made about the voicing unit 103 of FIG. 5, the CPU 107 may be designed to compute an accurate maximum amplitude value of the vibrating voltage making good use of the input/output characteristic of FIG. 2 employed in the drum pad circuit 1 of FIG. 1, in order to detect the maximum amplitude value of the vibrating voltage more accurately.

While, in the above description, drum pad circuits to be included in a music playing pad for an electronic percussion musical instrument are illustrated as embodiments of the strike input device according to the present invention. Alternatively, the present invention can be practiced in a music playing stick to strike another arbitrary member to detect the strikes. Where there are game machines and personal data assistants which utilize strike event signals as their control signal, in which strike operations applied to the control members are detected and utilized for the various controls. The strike input device according to the present invention can be used also in a strike detection circuit of such control members.

While several preferred embodiments have been described and illustrated in detail herein above with reference to the drawings, it should be understood that the illustrated embodiments are just for preferable examples, that the present invention may not necessarily be limited to the illustrated embodiments, and that the present invention can be practiced with various modifications, improvements and combinations without departing from the spirit of the present invention.

What is claimed is:

1. A strike input device comprising:

an impact sensor for generating a first vibrating voltage in response to a striking force; and a nonlinear circuit having a nonlinear input/output characteristic and outputting a second vibrating voltage in accordance with the first vibrating voltage input from the impact sensor, the second vibrating voltage being nonlinearly related to the first vibrating voltage, wherein the nonlinear input/output characteristic represents a first increase rate of the absolute value of the output voltage to the absolute value of the input voltage where the absolute value of the input voltage is in the lower range, a second increase rate of the absolute value of the output voltage to the absolute value of the input voltage where the absolute value of the input voltage is in the middle range, and a third increase rate of the absolute value of the output voltage to the absolute value of the input voltage where the absolute value of the input voltage is in the higher range, the first increase rate being greater than the second increase rate, the third increase rate being smaller than the second increase rate but not zero.

2. A strike input device as claimed in claim 1, wherein the nonlinear input/output characteristic represents a first increase rate of the absolute value of the output voltage to the absolute value of the input voltage where the input voltage is lower than a first threshold voltage, a second increase rate of the absolute value of the output voltage to the absolute value of the input voltage where the input voltage is higher than the first threshold voltage and lower than a second threshold vantage, and a third increase rate of the absolute value of the output voltage to the absolute value of the input voltage where the input voltage is higher than the second threshold voltage, the first increase rate being greater than the second increase rate, the third increase rate being smaller than the second increase rate but not zero.

3. A strike input device as claimed in claim 1, wherein the nonlinear circuit is comprised of a series connection of a linear resistance circuit and a nonlinear resistance circuit, the output being taken across the nonlinear resistance circuit, wherein the nonlinear resistance circuit is comprised of a parallel connection of at least a first resistance circuit and a second resistance circuit, the first resistance circuit including two diodes connected in parallel in an opposite polarity to each other, the second resistance circuit including two Zener diodes connected in series in an opposite polarity to each other.

* * * * *